United States Patent [19]

Flakas et al.

[11] Patent Number: 4,930,146

[45] Date of Patent: May 29, 1990

[54] X-RAY TUBE CURRENT CONTROL WITH CONSTANT LOOP GAIN

[75] Inventors: Gerald K. Flakas, Oconomowoc; Harold J. Dalman, Brookfield, both of Wis.

[73] Assignee: General Electric Company, Milwaukee, Wis.

[21] Appl. No.: 377,353

[22] Filed: Jul. 10, 1989

[51] Int. Cl.[5] ..... H05G 1/34

[52] U.S. Cl. ..... 378/110; 378/109; 378/114

[58] Field of Search ..... 378/109, 110, 114, 115

[56] References Cited

U.S. PATENT DOCUMENTS

| | | | |
|---|---|---|---|
| 4,187,442 | 2/1980 | Huechen et al. | 378/128 |
| 4,253,048 | 2/1981 | Osako | 378/110 |
| 4,322,625 | 3/1982 | Daniels et al. | 378/110 |
| 4,477,868 | 10/1984 | Steigerwald | 363/28 |
| 4,504,895 | 3/1985 | Steigerwald | 363/25 |
| 4,596,029 | 6/1986 | Manneco et al. | 378/112 |
| 4,775,992 | 10/1988 | Resnick et al. | 378/109 |
| 4,809,311 | 2/1989 | Arai et al. | 378/109 |

*Primary Examiner*—Janice A. Howell
*Assistant Examiner*—John C. Freeman
*Attorney, Agent, or Firm*—Quarles & Brady

[57] ABSTRACT

The tube current in an X-ray tube is controlled by a closed loop control circuit in which a tube current feedback signal is used to control X-ray tube filament current. The gain of the feedback loop is maintained substantially constant over a wide range of tube currents by inserting a signal proportional to the reciprocal of the tube current command.

3 Claims, 3 Drawing Sheets

X-RAY TUBE CURRENT CONTROL WITH CONSTANT LOOP GAIN

BACKGROUND OF THE INVENTION

The field of the invention is the control of anode current in an x-ray tube and, particularly, the precise control of anode current in an x-ray tube of the type used in CT scanners.

As shown in FIG. 1, an x-ray tube 10 includes a thermionic filament 11 and an anode 12 which are contained in an evacuated envelope 13. An ac current IF of 2–6.5 amps is applied to the filament 11 causing it to heat up and emit electrons. A high dc voltage of from 50 to 150 kilovolts is applied between the filament 11 and the anode 12 to accelerate the emitted electrons and cause them to strike the target material on the anode 12 at high velocity. X-ray energy indicated by dashed line 14 is emitted as a result.

The amount of x-ray energy which is produced is determined by the high voltage level and the amount of tube current $I_T$ which flows between the filament 11 and the anode 12. The high voltage is set to a selected value and the high voltage power supplies 15 and 16 maintain that value during the entire scan. The tube current $I_T$ is controlled by controlling the amount of filament current $I_F$, and this in turn is controlled by the ac voltage produced at the secondary winding of a filament transformer 17. The relationship between tube current $I_T$ and applied filament current is nonlinear and is typically exponential.

In a CT scanner, it is common practice to change the filament current between scans in order to change the level of x-ray production. Consequently, the filament current control circuit must be capable of rapidly bringing the filament current to a level which results in the desired x-ray tube current $I_T$ before each scan is begun.

In CT scanning, a high degree of precision is required in the amount of x-rays produced since the attenuation data is sequentially obtained during the entire scan procedure and the method employed to reconstruct an image from this acquired data presumes that the x-ray energy remains constant during the entire scan. This requires that tube current $I_T$ be very precisely controlled.

Referring still to FIG. 1, these requirements are met by filament current control systems which operate in an open loop mode during the preheating of the filament and a closed loop mode when x-rays are produced and tube current $I_T$ is to be precisely controlled. During the open loop mode of operation, a preheat current command is applied to the input of a digital-to-analog (D/A) converter 20 by a digital control system (not shown). The resulting analog preheat current command is amplified by amplifier 21 which also limits the magnitude of the command to a safe level, and the resulting signal is input to a filament driver 22. The filament driver 22 produces an ac output voltage that is applied to the primary of the filament transformer 17 and which produces the commanded filament current $I_F$. A filament current feedback signal produced by a current sensor attached to the primary or secondary of the filament transformer 17 is fed back through line 23 to force the filament current $I_F$ to the desired level by closed loop control action.

A short time interval later the high voltage is turned on to produce x-rays, and the current control system is switched to its closed loop mode of operation. This is accomplished by closing an analog switch 25 with a command signal from the digital control system through line 26. This applies a feedback signal to a summing point 27 at the input of amplifier 21 that adds to the preheat current command and adjusts the filament current $I_F$ to a point which produces the desired x-ray tube current $I_T$.

The tube current $I_T$ is measured by a resistor 30 which is connected in series with the high voltage power supplies 15 and 16 and which is connected across the inputs of an operational amplifier 31. In a high performance system, this tube current feedback signal is summed with a tube current command signal at an error amplifier 32 and the difference, or error, signal is applied to the input of a variable gain amplifier 33. The tube current command is typically issued in digital form by the digital control system and is converted to an analog command signal by D/A converter 34. The tube current command signal is the value which determines the amount of x-rays that are to be produced during the scan at the selected high voltage level. The resulting feedback signal produced by amplifier 33 forces the actual tube current $I_T$ to equal the tube current command by controlling the filament current $I_F$ through feedback control action at the summing point 27.

To maintain steady state accuracy and the desired transient response, the overall gain and phase of the tube current feedback loop should be maintained constant over the entire operating range, which may be from under 10 milliamperes to over 1,000 milliamperes in a CT x-ray tube. However, it is well known that the transfer function of the x-ray tube, defined as the incremental change in tube current $I_T$ caused by an incremental change in filament current $I_F$, is dependent on the level of the tube current $I_T$. As a result, to achieve high performance throughout its operating range prior current control systems include the variable gain amplifier 33 in the tube current feedback loop to compensate for the variability of the tube transfer function to obtain roughly constant loop gain. That is, each time the tube current command is changed, a gain command is also applied to the variable gain amplifier 33 through line 35 to adjust the loop gain and to thereby accommodate the different x-ray tube transfer function brought about by the different tube current $I_T$. If the loop gain is not maintained at a relatively constant level, the control system is inaccurate and responds poorly at low tube current levels and may be unstable at high tube current levels.

SUMMARY OF THE INVENTION

The present invention is an improvement in the current control system for an x-ray tube and, particularly, a tube current feedback loop which maintains substantially constant loop gain over a wide range of x-ray tube currents. More particularly, the improvement includes: a multiplying D/A converter which receives a feedback signal at a reference input that is proportional to x-ray tube current $I_T$, that receives a digital input that is proportional to the reciprocal of a tube current command, and which generates an output signal that is proportional to the product of the two input signals; and an error amplifier which couples the output signal from the multiplying D/A converter to a summing point at which it is combined with a preheat current command signal to control the x-ray tube filament current.

A general object of the invention is to maintain a relatively constant loop gain for the tube current feedback loop. Loop gain is automatically independent of tube current $I_T$, since the gain of the multiplying D/A converter is proportional to the digital input signal that is the reciprocal of commanded tube current. Thus, the increase in loop gain which occurs at higher tube currents $I_T$ is substantially offset by the corresponding lower gain of the multiplying D/A converter.

Another object of the invention is to reduce the complexity of the current control system. The multiplying D/A converter performs the dual function of inserting the digital tube current command into the tube current feedback loop and adjusting loop gain as a function of tube current. As a result, separate D/A converter and variable gain amplifier circuits are not required.

The foregoing and other objects and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims herein for interpreting the scope of the invention.

DESCRIPTION OF THE PREFERRED EMBODIMENT

Figure 1:
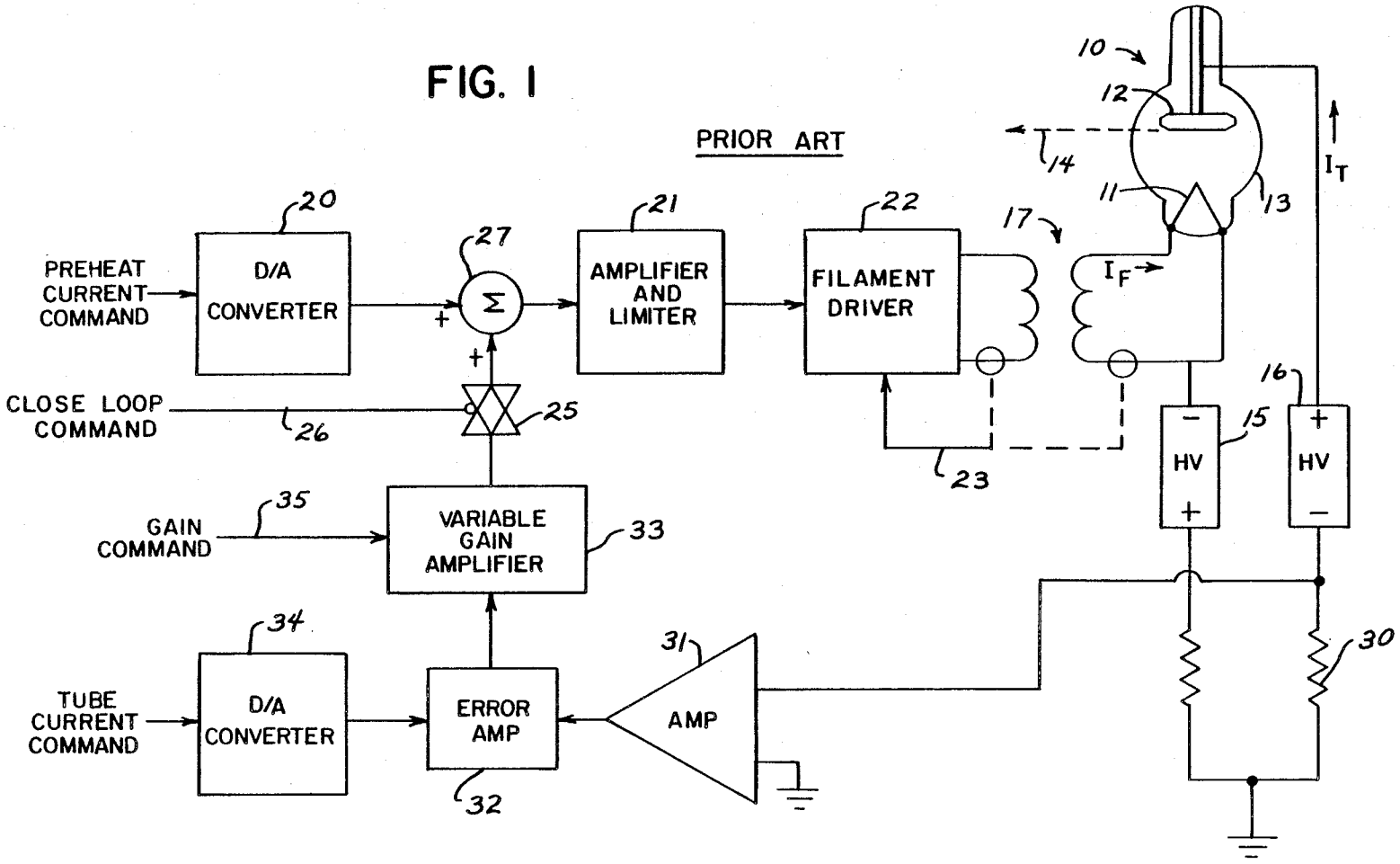
FIG. 1 is a block diagram of a prior art x-ray tube current control system.
Figure 2:
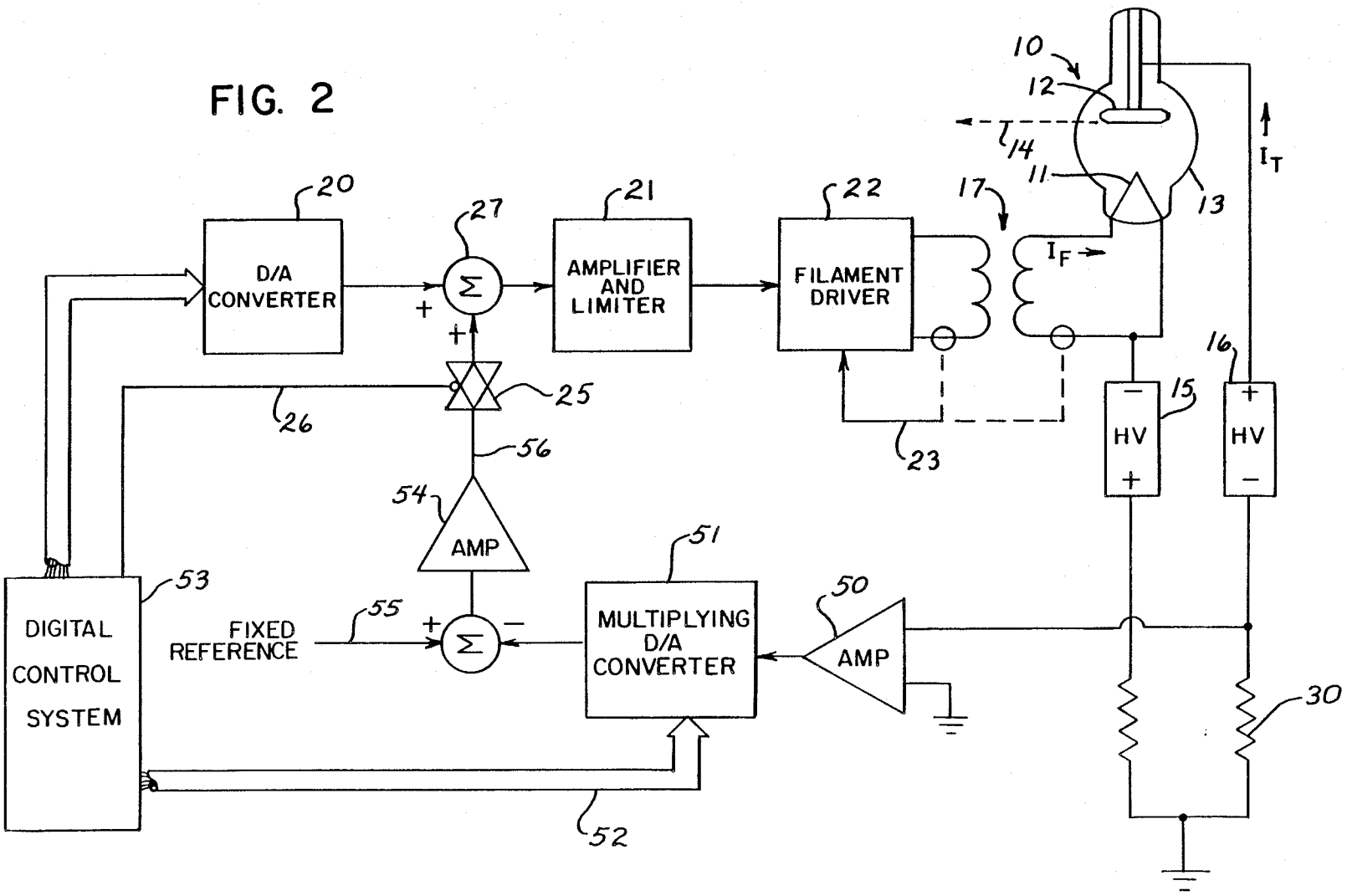
FIG. 2 is a block diagram of a preferred embodiment of an x-ray tube current control system which incorporates the present invention.

Referring particularly to FIG. 2, many of the elements of the current control system of FIG. 1 are employed in the preferred embodiment of the invention. These have been marked with the same reference numbers and include the open loop elements comprising the D/A converter 20, the summing point 27, the analog switch 25, the amplifier and limiter 21, the filament driver 22, and the filament transformer 17. Circuitry for these elements is described in U.S. Pat. No. 4,322,625 entitled "Electron Emission Regulator For An X-Ray Tube Filament" and assigned to the assignee of the present invention. The x-ray tube 10 is exemplified by that described in U.S. Pat. No. 4,187,442 entitled "Rotating Anode X-Ray Tube With Improved Thermal Capacity", although there are many types of x-ray tubes which can be used with the present invention.

Similarly, the high voltage supplies 15 and 16 are well known to the art and may be constructed as described in U.S. Pat. Nos. 4,504,895 and 4,477,868 and controlled by a digital control system as described in U.S. Pat. No. 4,596,029.

The present invention is an improvement to the current control system of FIG. 1 in which the elements of the tube current feedback loop have been changed. Referring to FIG. 2, the improved feedback loop includes an amplifier 50 which has its inputs connected across a resistor 30 to sense the magnitude of x-ray tube current $I_T$. As tube current $I_T$ increases, the voltage drop across resistor 30 increases and the voltage, or tube current feedback signal, applied to amplifier 50 increases.

The output of amplifier 50 is applied to the reference input of a multiplying D/A converter 51 which also receives as an input a 12-bit digital number through bus 52. This 12-bit digital number is produced by a digital controller 53 and it is proportional to the reciprocal of the tube current command. The analog output of the multiplying D/A converter 51 is applied to the input of an error amplifier 54 where it is subtracted from a positive fixed reference signal on line 55. The resulting tube current error signal is output through line 56 to the analog switch 25.

At the beginning of each scan, the digital control system 53 issues a 12-bit preheat current command to the D/A converter 20. This causes current to be applied to the x-ray tube filament 11 for a few seconds and brings it up to operating temperature. High voltage is then applied to the x-ray tube 10 by the supplies 15 and 16 and 5 to 10 milliseconds thereafter, the digital control system 53 issues a close loop command through control line 26 which closes the analog switch 25.

The digital control system 53 also calculates the 12-bit binary number that is to be output to the multiplying D/A converter 51. This is accomplished by dividing the desired, or commanded, x-ray tube current number into a normalization constant and outputting the result on the bus 52. The tube current feedback signal from amplifier 50 is multiplied by this 12-bit binary number which is the reciprocal of the tube current command, and the resulting output from D/A converter 51 is a current feedback signal which has been scaled by a factor which is inversely proportional to x-ray tube current. This scaling factor substantially offsets the increase in tube current feedback loop gain which occurs as a result of an increase in x-ray tube current $I_T$. Thus, the loop gain remains substantially constant regardless of the value of the tube current command and the consequent value of the x-ray tube current $I_T$.

The factored tube current feedback signal is subtracted from the fixed reference at error amplifier 54 and the resulting tube current error signal is coupled through the analog switch 25 to provide the desired feedback control action at summing point 27.

In addition to controlling loop gain, the factoring of the tube current feedback signal by the multiplying D/A 51 also maintains the voltage levels applied to the error amplifier 54 within a relatively small range over the entire operating range of the x-ray tube. In other words, at very low x-ray tube current levels the output of the multiplying D/A converter 51 is substantially the same as the output when the x-ray tube is operated at very high current levels. This significantly reduces the offset voltage requirements of the error amplifier 54 with a consequent reduction in its cost.

Figure 3:
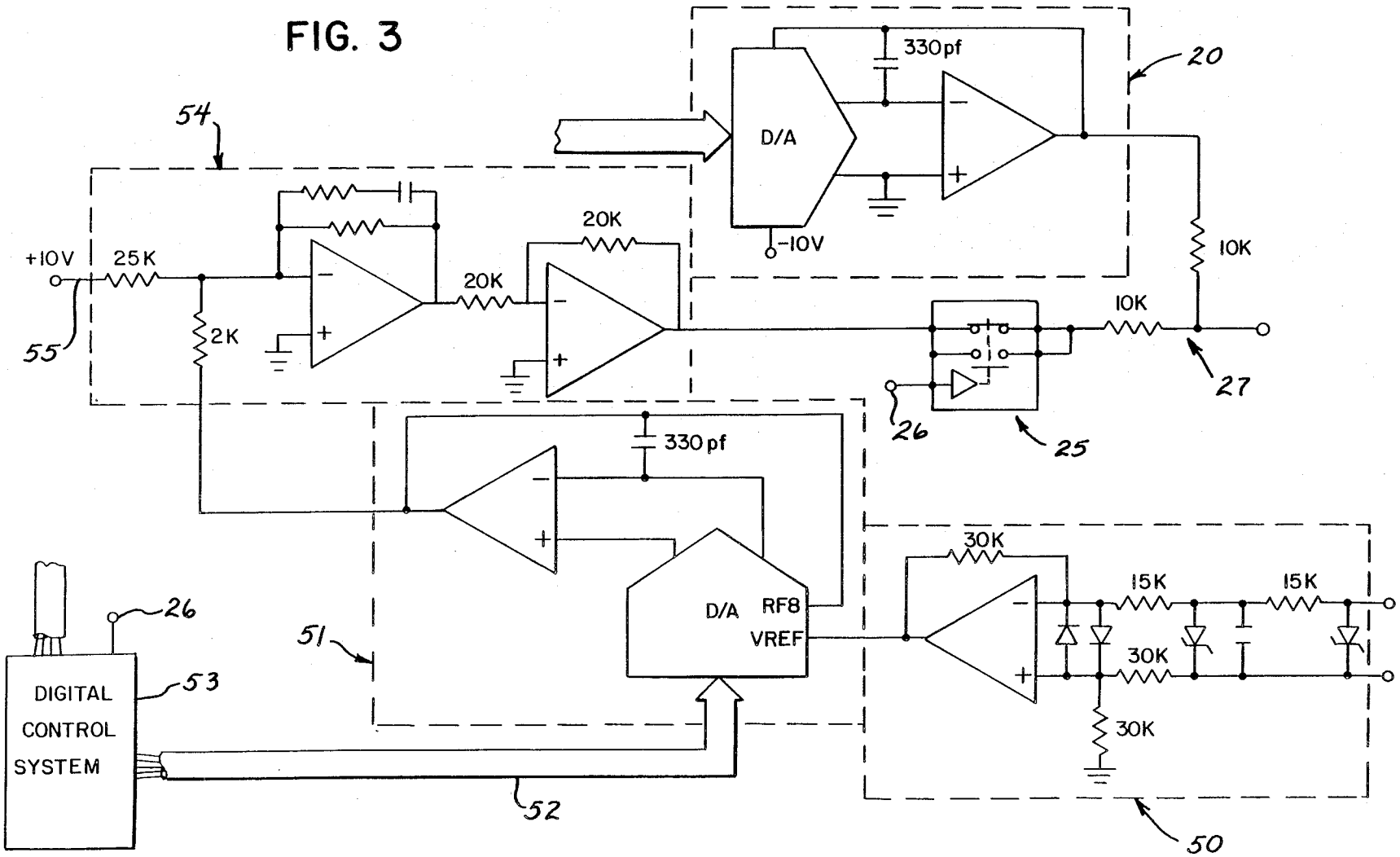
FIG. 3 is an electrical schematic diagram of portions of the system of FIG. 2.

A more detailed circuit diagram of the tube current feedback loop elements is shown in FIG. 3. The operational amplifiers are model nos. OP27 (amp 50) and OP07 (amps 51, 54, and 20) manufactured by Precision Monolithics, Inc. and described in PMI Databook, published in 1986 by Precision Monolithics, Inc. The multiplying D/A converters are model no. AD7541A manufactured by Analog Devices and described in Analog Devices Data Conversion Handbook, published in 1988 by Analog Devices, Inc. The analog switch 25 is a model no. DG303A manufactured by Siliconix, Inc. and described in Integrated Circuits Databook, published in 1988 by Siliconix, Inc.

It should be apparent that many variations are possible from the preferred embodiment. For example, the preheat current command may represent filament voltage, and the filament driver 22 may produce the corresponding voltage. The feedback of filament current or voltage may be derived from either the primary or secondary winding of transformer 17, and this feedback may include rate of change of the controlled filament parameter in order to implement derivative control or lead compensation and to thereby provide damping of the filament control loop. An offset may also be added to the filament current command to compensate for the well known space charge characteristic of x-ray tubes, whereby the filament heating must be increased as applied high voltage is reduced in order to maintain constant tube current $I_T$.

We claim:

1. In a current control system for an x-ray tube having a filament driver which supplies current to the x-ray tube filament in response to a preheat command signal, the improvement comprising:

means for producing a tube current feedback signal which indicates the amount of current flowing between the filament and the anode of the x-ray tube;

means for producing a command signal which is proportional to the reciprocal of a tube current command;

multiplying means for multiplying the tube current feedback signal by the command signal to produce a tube current error signal;

subtraction means for subtracting the tube current error signal from a reference signal to produce a corrected tube current error signal;

summing means for combining the preheat command signal with the corrected tube current error signal to produce a filament command signal to control the tube filament temperature and cause the tube current to attain a value indicated by the tube current command; and means for supplying said filament command signal to said filament drive.

2. The improvement as recited in claim 1 in which the multiplying means is a multiplying digital-to-analog converter and the command signal is a multi-bit digital signal.

3. The improvement as recited in claim 1 in which the summing means includes an analog switch that is operable to combine the correcting tube current error signal with the preheat command signal at a time interval after the application of the preheat command signal.

* * * * *